United States Patent [19]

Batey et al.

[11] Patent Number: 4,864,972

[45] Date of Patent: Sep. 12, 1989

[54] BOILER OPTIMIZATION FOR MULTIPLE BOILER HEATING PLANTS

[76] Inventors: John E. Batey, 176 B Summer St., New Canaan, Conn. 06840; Edward H. Brzezowski, 23 Paul Dr., Succasunna, N.J. 07876

[21] Appl. No.: 59,542

[22] Filed: Jun. 8, 1987

[51] Int. Cl.[4] ..... F22B 37/42

[52] U.S. Cl. ..... 122/448 B; 237/8 A

[58] Field of Search ..... 122/448 R, 448 B; 237/8 R, 8 A; 236/1 E, 1 EA, 91 R, 91 B, 91 E, 91 F, 91 G; 364/557

[56] References Cited

U.S. PATENT DOCUMENTS

| | | | |
|---|---|---|---|
| 3,576,177 | 4/1971 | Block | 122/448 B |
| 4,069,675 | 1/1978 | Adler et al. | 122/448 B X |
| 4,234,927 | 11/1980 | First | 364/557 |
| 4,418,541 | 12/1983 | Russell | 122/448 B |
| 4,522,333 | 6/1985 | Blay, Jr. et al. | 236/20 R |
| 4,527,246 | 7/1985 | Masson | 237/8 R X |
| 4,583,497 | 4/1986 | Likins, Jr. et al. | 122/448 B |
| 4,598,668 | 7/1986 | Bader | 122/448 B |
| 4,637,349 | 1/1987 | Robinson | 122/448 B |

*Primary Examiner*—Edward G. Favors

*Attorney, Agent, or Firm*—Frisenda, Morris & Nicholson

[57] ABSTRACT

A method and apparatus is provided for operation and optimization of boilers in a multiboiler heating plant. The apparatus includes a boiler selection means which is typically a computer which includes a fuel consumption profile for the boilers in the plant. A boiler controller is connected to the boiler selection means. An outdoor air temperature sensor is provided. In operation the fuel consumption profile of the various boilders at the current outdoor air temperature are compared and the boiler which will consume the least amount of fuel per degree day or other time unit is selected for operation.

26 Claims, 3 Drawing Sheets

FROM FUEL SOURCE
BOILER EFFICIENCY DATA INPUT
FUEL CONSUMPTION INPUT
COMPUTER
100
TEMP SENSOR
114
FUEL CONSUM. PROFILE
116
ALARM
112
MODEM
120
DISPLAY
152
DISPLAY
108
COMPUTER INTERFACE
109
BOILER CONTROLLER
110
FUEL VALVE 130
FUEL VALVE 132
FUEL VALVE 134
FUEL VALVE 136
FUEL METER 122
FUEL METER 124
FUEL METER 126
FUEL METER 128
BOILER 1
BOILER 2
BOILER 3
BOILER 4
150

BOILER OPTIMIZATION FOR MULTIPLE BOILER HEATING PLANTS

BACKGROUND OF THE INVENTION

1. Field of the Invention

The present invention relates to boiler optimization in heating plants which have more than one boiler available for use. Typically, in multiple boiler heating plants the operator has a choice between the operation of one boiler or a combination of boilers to meet the heating needs for a given outdoor air temperature. Under such circumstances the choice of which boiler or boiler combination that should be operated for a particular heating load caused by the outdoor air temperature is not self evident. Thus, typically the boilers will be turned on in a random fashion by the operator to meet the load requirement at hand.

The present invention provides a sophisticated method for determining which boiler or boiler combination in the central heating plant should be put in use depending on the current outdoor air temperature. An apparatus to automatically perform such optimized operation is also provided as well as a method of diagnosis of boilers which require servicing.

2. Description of the Prior Art

Efforts have been made in the prior art to optimize boiler operation and selection in multiple boiler plants. For example, U.S. Pat. No. 4,637,349 discloses a system for controlling central heating boilers of large capacity in which the boiler is switched on and off when the boiler's flow temperature reaches a predetermined maximum or minimum. The boiler flow temperatures are varied dependently upon the outside air temperature in such a manner that as the outside air temperature rises the boiler is switched on at a progressively lower boiler flow temperatures. The result of this boiler cycle controller is to achieve longer boiler cycling. Another example of boiler optimization is set forth in U.S. Pat. No. 4,418,541. There a boiler loading system for a plurality of boilers in a power plant is disclosed. Each of the boilers is continuously monitored for an optimum efficiency change whether for a boiler load increased demand or a boiler load decreased demand. The boiler with the largest efficiency change for a boiler load increase is then selected to satisfy the plant demand. The boiler with the lowest deficiency change decrease is selected where the load demand is for a reduced load. Such a system requires the monitoring of each boiler's fuel flow and load and the establishment for each boiler of an efficiency characteristic function which relates fuel cost to steam flow. None of the prior art methods provide a simple adaptive method or apparatus for selecting and operating optimum boiler or boiler combinations in multiple boiler plants depending on the current outdoor air temperature and historic and current fuel consumption.

SUMMARY OF THE INVENTION

The present invention relates to optimizing the operating efficiency of boilers in central heating plants. According to the invention a method of boiler optimization of multiple unit boiler heating plants and apparatus for implementing the optimization are provided. In another aspect of the invention a method of diagnosis of boiler inefficiency and servicing requirement and an apparatus relating thereto are also provided. In addition, according to the invention an adaptive apparatus for determining the most efficient boiler combination is provided wherein current data is used in determining the most efficient boiler or boiler combination.

According to the invention a method of optimizing boiler efficiency in multiple boiler heating plants is provided by first operating each boiler in the heating plant system and each boiler combination which will satisfy the load demand for a particular degree-unit time (e.g., degree day, degree hour, degree shift) over a preselected range of outdoor air temperatures preferably over the range of outdoor air temperatures typically encountered during a heating season. The fuel consumption for each boiler or boiler combination per degree-unit time is then calculated for a given degree-unit of time. The current outdoor temperature is then measured and converted into degree-unit time, e.g., degree days. One then selects the boiler or boiler combination which has lowest fuel consumption per degree unit time e.g., degree days for the degree days equivalent to the measured outdoor temperature. The selected boiler or boiler combination is turned on to provide heat as required. According to the invention, only two simple measurements are required, amount of fuel used and the outdoor air temperature.

In another aspect of the invention, the fuel consumption of the boilers or boiler combination which is in operation is continuously monitored as is the outdoor air temperature. The data is fed to a computer that will display the appropriate boiler combination for the current outdoor air temperature. Optionally, the data can be continuously processed to adapt the historical data to current boiler efficiencies. Thus, if over a period of time the boiler efficiency of an optimized selected boiler or boiler combination falls below that of the historical efficiency of another boiler combination such new combination will be selected.

As used in this application the term fuel consumption profile means amount of fuel consumed per degree-time (e.g., degree-day) by a boiler or boiler combination for a specified degree-time period e.g., a degree day or a degree hour for a plurality of outdoor air temperature typical of those which are encountered during a heating season.

Preferably, the invention includes diagnostic capability. Thus, when a boiler or boiler combination operates and consumes a greater amount of fuel per degree than is predicted from the history, the operator will be informed by printer readout or optionally by an alarm.

The preferred embodiment of the present invention is illustrated in the drawings. However, it should be expressly understood that the present invention should not be limited solely to the illustrative embodiment.

DETAILED DESCRIPTION OF THE INVENTION

The subject invention provides a method and apparatus for determining optimum boiler combination for operation in a multi-boiler heating plant. According to the invention, each boiler or boiler combination in the heating plant system which will satisfy the load requirement for a particular degree day is operated over a preselected range of outdoor air temperature typically encountered in a heating season and the amount of fuel consumed at a particular outdoor temperature is ascertained for each boiler combination. The amount of fuel consumed per degree day is then calculated. The current outdoor temperature is measured and converted into degree days and the boiler or boiler combination with the lowest amount of fuel consumption per degree day for the current degree day reading is selected for operation. Optionally, historical data from the latest heating season can be used to arrive at the fuel consumption per degree data for the boiler or boiler combinations that have been historically operated. As a result of employing the claimed invention, fuel saving of a range of up to 15 percent or more can be expected in the typical heating plant.

According to the invention the optimum boiler selection procedures based on fuel use per degree day versus degree days or related temperature-time parameters incorporate a number of approaches. Measured fuel use and outdoor air temperature can be used to establish a fixed boiler selection schedule. Such data can be compiled by systematic operation of the boiler over the range of degree days in a heating season. Optionally historical data may be available which will enable boiler optimization. In another aspect of the invention computer based methods that continually process boiler fuel use and outdoor air temperature data and automatically adapt to changing boiler efficiencies over time are employed. The computer can supply continuously updated advisory information to boiler plant operators regarding the most efficient combination of boilers to operate as a function of boiler load (outdoor air temperature). Third, adaptive computer-based optimization methods that feature automatic boiler operation by the computer (without operator intervention) can optionally be employed in practicing the invention. Finally, by employing the invention, boiler diagnostic functions can be performed that continuously monitor changes in the efficiency of each boiler over time. When a boiler efficiency falls below a predetermining efficiency level (fuel use per degree-day at a specified load), then the plant operators can be advised that efficiency maintenance improvements are required. This level of accurate boiler efficiency information is commonly not available to heating plant operators, and it can improve the overall efficiency of the boiler plant by identifying the efficiency degradation of individual boilers. Repairs to improve efficiency can be completed quickly, before excess fuel use occurs.

Figure 1:
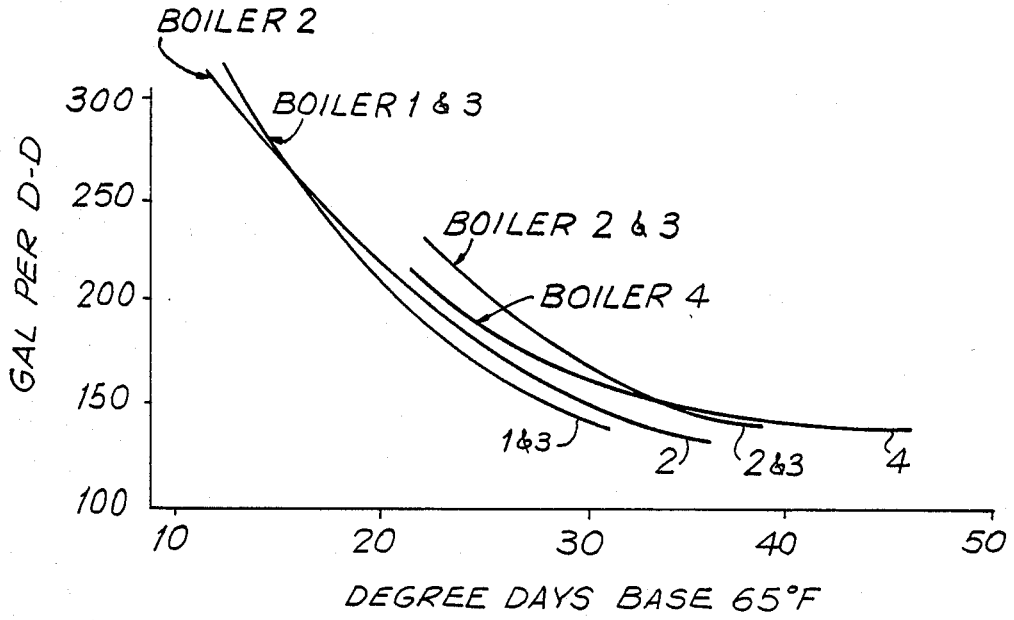
FIG. 1 is a plot of gallons of fuel oil/Deg. Day vs. Degree Day based on actual operating data for a heating plant containing four (4) boilers.

Referring to FIG. 1 which is plot of fuel oil consumption vs. degree day for a four boiler plant based on actual operating data from the previous heating season, one can see how the invention is employed. The heating history of a central heating plant containing four (4) boilers is shown in FIG. 1. Fuel use efficiency, in terms of gallons of fuel oil per degree-day (Gal per DD), are plotted as a function of degree-days for an entire heating season. A degree-day is defined as 65 degrees F. minus the average outdoor temperature for the day. Thus, if the outdoor air temperature is 30 degrees F. for a 24 hour interval, then 35 degree-days are accrued. The curves in FIG. 1 indicate that large differences exist in Gal per DD (boiler plant efficiency) for the boilers combinations used at the plant. For example, at 30 degree days boilers 1 and 3, 2, 2 and 3, and 4 were operated with Gal per DD ranging from approximately 140 Gal per DD to 170 Gal per DD. This is a 21 percent difference in fuel use depending on which boiler or boiler combination is selected. Note that the higher efficiency boilers correspond with low gallons per degree day and lower curves.

According to the invention, a schedule is set forth in Table 1 based on the data in FIG. 1. Optionally, these operating schedules can be manually updated periodically based on current boiler operating data.

TABLE I

Boiler Optimization Schedule

| Degree-Day Range | Optimum Boiler Combination |
|---|---|
| Below 16 | Boiler 2 |
| 16–31 | Boilers 1 and 3 |
| 31–37 | Boiler 2 |
| 37–39 | Boilers 2 and 3 |
| Above 39 | Boiler 4 |

In this case the boiler plant operators would operate the most efficient available boiler(s)(with the lowest gallons per degree day) as a function of outdoor air temperature (degree days).

Figure 3:
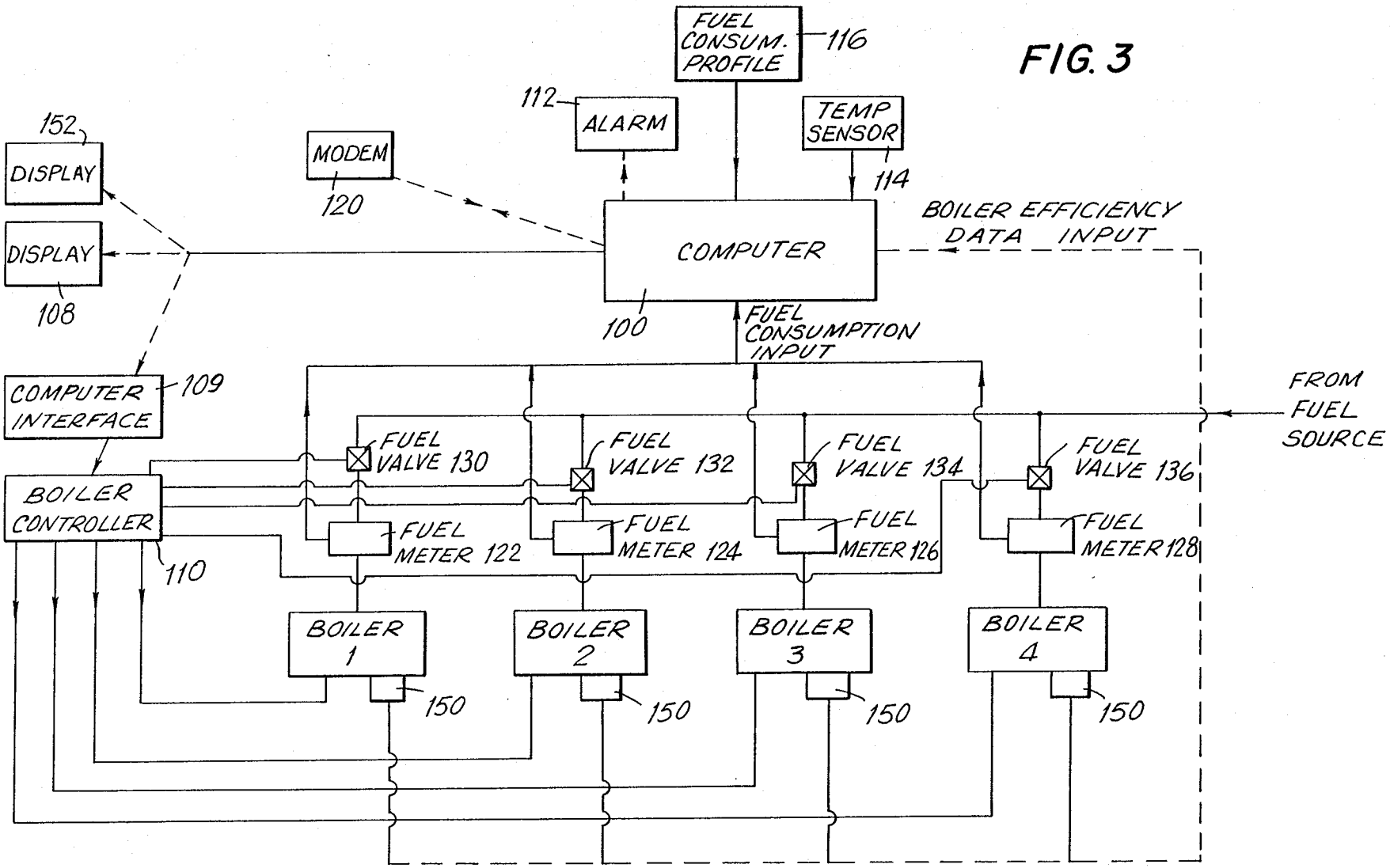
FIG. 3 is a schematic diagram of an apparatus used according to the invention to perform the boiler optimization according to the invention.

In another aspect of the invention, computer aided analysis is employed to determine the boiler selection based on current outdoor air temperature and fuel consumption per degree day for each possible boiler combination. As best seen in FIG. 3 the previously measured data for the fuel consumption per degree day for each boiler or boiler combination for the range of degree days encountered in a heating season is inputted into an industrial microcomputer such as a UMAC 5000 manufactured by Analog Devices or other computer 100. The current air temperature is continuously monitored by conventional temperature sensor 114 inputted into the computer. Fuel consumption profile 116 for at least some of the possible boiler combinations is also inputted into the computer. Based on the fuel consumption profile 116, the computer 100 selects the boiler or boiler combination for operation at the current temperature and signals the boiler controller 110 through computer interface 109 for automatic operation of the boilers selected. Optionally, the computer 100 communicates with display 108 which is preferably a CRT display or optionally a printer on which it displays the appropriate boiler selection for manual activation by the operator instead of automatic operation by the boiler controller 110.

A more sophisticated system can be provided according to the invention. According to such, the fuel consumption for each boiler per degree day is continuously monitored as is the current outdoor air temperature. Thus, fuel flow meters 122, 124, 126, 128 attached to the flow inlet of each boiler is inputted into the computer 100 which processes the data to adjust the fuel consumption profile of the boilers in operation.

Thus, according to such a sophisticated system, boiler selection is adaptive and can take into account changing boiler conditions over time. In another aspect of the sophisticated system, a comparison loop is provided which monitors the current fuel consumption per degree day vs. outdoor air temperature and compares it against the fuel consumption profile. Where the current consumption is more than a preselected percentage above the comsumption indicated from the fuel consumption profile (for example, an increase of 5% or more) a signal is generated to inform the operator that the boiler is in need of servicing preferably an alarm 112 or optionally a CRT display or diagnostic printer.

Figure 2:
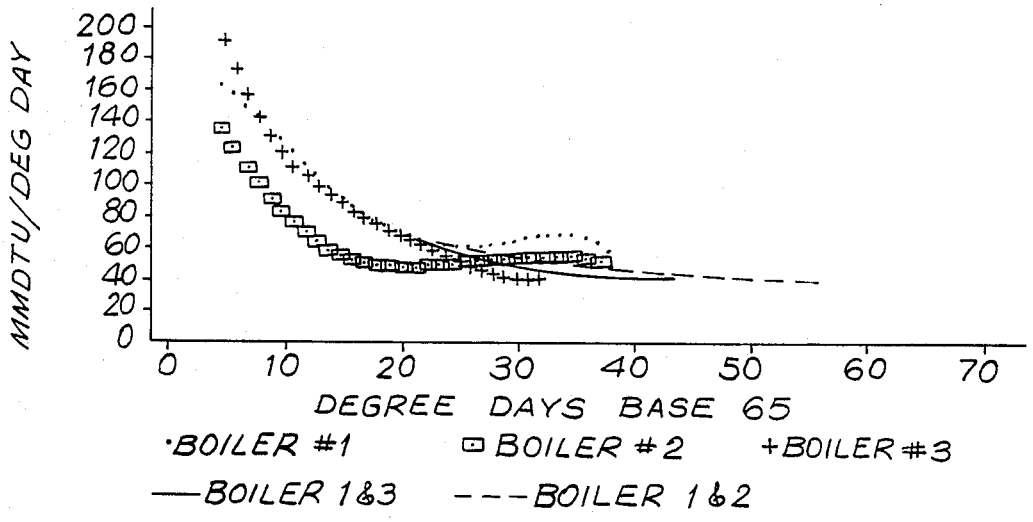
FIG. 2 is a plot of gallons of fuel per degree temperature versus degree days based on actual operating data for a central heating plant containing three (3) boilers.

FIG. 2 is a plot of gallons per degree day versus degree day for a central heating plant with three (3) boilers. Five curves are included as follows: boilers 1, 2, 3, 1 and 2, 1 and 3. These curves are based on fourth order polynomial curve fits of daily operating data for one complete heating season. Fuel use efficiency, in terms of gallons per degree day, varies over a wide range at each degree day (outdoor air temperature). At 30 degree days (outdoor air temperature of 35 degrees F.) the gallons per degree day range from approximately 39 to 61- a fuel use range of 56 percent depending on which boilers are operated. Detailed daily optimization calculations for a complete heating season indicate that fuel use can be reduced by more than 15 percent through optimum boiler selection of the plant load. The analysis methods that are included in this invention compare the relative efficiencies of each boiler combination under the same load conditions to select the most efficient boiler combinations.

The adaptive features of this invention can also be illustrated by referring to FIG. 2. These are fourth order polynomial curves representing the fuel consumption profiles. According to the invention, a computer system continuously receives fuel use and outdoor air temperature information and updates the gallon per degree day versus degree day profiles on a regular basis. This permits the boiler optimization curves based on computer data arrays to adjust to changes in boiler efficiency over time. For example, if excess combustion air levels increase and change the overall efficiency of a boiler, or if boiler tubes acquire soot deposits, then the fuel use per degree day for individual boilers will change, and the boiler optimization system can automatically adjust the optimum boiler selection schedule. According to the adaptive feature of this invention, operation of efficient boilers into new degree day ranges in which they have not operated historically can be initiated. For example, boiler 3 is the most efficient boiler at 32 degree days when its operation was terminated. The adaptive feature of the system optionally permits extension of efficient boiler operation into other degree day regimes, producing additional fuel savings.

As set forth above, computer based systems permit additional useful applications of the fuel use per degree day versus degree day analyses. Optionally diagnostic functions can be incorporated to track changes in boiler efficiency (fuel use per degree day) over time. If the efficiency of a boiler or boiler combination drops below the pre-selected action range (a five percent increase in fuel use per degree day for example), then the boiler plant operators can receive advisory information from the computer display 108 (video display (CRT) or printer), so that correction actions can be taken promptly before fuel consumption increases excessively.

Optionally other boiler efficiency parameters can be measured and monitored by sensors 150 and fed to computer 100. Thus, flue gas temperature, flue gas oxygen ($O_2$) flue gas CO, opacity, boiler temperature and/or pressure, and other boiler efficiency parameters can be monitored and when such parameters exceed certain predetermined level a signal, for example, by a diagnostic alarm 112 can be given to the operator to assist with identifying the cause of the efficiency decrease determined by the fuel use per degree-day versus degree-day analysis.

The display 108 may optionally present data to the user in tabular or graphical form. For example, if given in tabular form the possible boiler operation combinations may be given in descending order of efficiency. A graphical presentation plot the range of boilers with actual fuel use per degree day values shown. Display 108 or a second display 152 is optionally provided to present daily, weekly, monthly and cumulative year to date performance of fuel use and fuel use per degree day versus degree days. Efficiency targets based on optimum boiler selection and historic (non-optimum) fuel use can be displayed simultaneously to compare the degree of success of the optimum boiler selection procedures. The fuel use per degree-time such as degree-day, degree-hour, degree-shift, degree-month or degree-year can be used as an immediate and long-term measure of boiler optimization effectiveness. The output displays 108 and 152 can also be used by the diagnostic functions of the computer to identify boilers with excessive efficiency loss over time, based on fuel use per degree-time analyses. The computer can store optimum efficiency curves based fuel consumption data arrays for each boiler and display an alarm or warning for boiler operators when individual or combined boiler efficiencies fall by more than a preselected value. Optionally a modem 120 is provided to permit remote data access and control of the boiler optimization and diagnostic processes. This feature permits routine overview and supervision of the optimum boiler selection and diagnostic functions by others outside of the boiler plant. This feature is particularly important when the boiler plant personnel are responsible for using the computer output to operate the optimum boilers.

Optionally other optimization functions such as optimized fuel valve position of valves 130, 132, 134, 136 for the selected boiler combination can be controlled. During such operation, the computer automatically turns on the most efficient boiler or combination of boilers as a function of outdoor air temperature, time of day, day of week, shift, and other relevant parameters included in the control algorithms. Minimum boiler operating times (on the order of several hours) is also required to prevent short cycling of boilers resulting in excess fuel use and boiler wear. Optimized fuel valve positioning is a second level control function that further improves overall efficiency and optionally is controlled according to the invention. After the optimum boiler combination is selected based on fuel use per degree day versus degree days and more than one boiler is selected then the most efficient positioning of the fuel valves 130, 132, 134, 136 as appropriate is determined by again applying the fuel use per degree day versus degree day analysis. Optionally when more than one boiler is operated simultaneously, the effect of various loading levels on the multiple boilers (50-50, 40-60, 60-40, 30-70, 70-30, for example) is monitored at each degree day interval to identify the optimal fuel valve position for the optimum boilers at each degree day (outdoor air temperature) interval. Automatic variation of the fuel valve positions is made by the computer, followed by fuel use data analyses and identification of the optimum fuel valve positioning.

Figure 4:
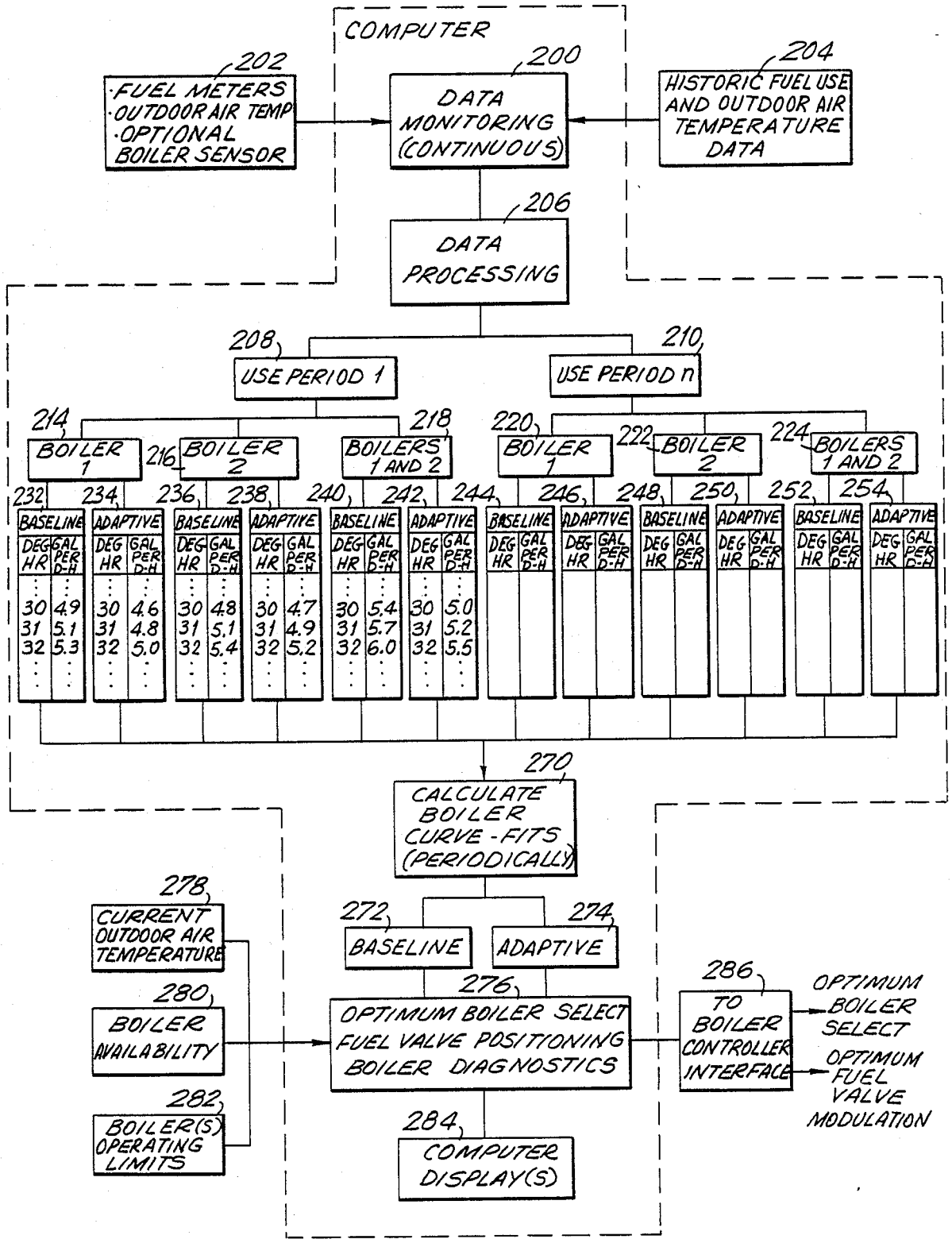
FIG. 4 is a flow chart of boiler optimization based on the invention.

FIG. 4, presents the boiler optimization flow chart. The example shown is for two (2) boilers and two use periods. A use period can be operating shifts such as 7 A.M. to 3 P.M. and 3 P.M. to 7 A.M., or any other periods of time, being two or more, that effect the boiler load characteristics as a function of outdoor air temperature. The number of boilers can be two or more including all operative boiler combinations.

Data is input to the computer 200 as historic fuel use and corresponding outdoor air temperatures 204, and continually updated by fuel meters and outdoor air temperature sensors 202. Optional sensor data is also input for diagnostic purposes. The computer then processes 206, all of this information by sorting fuel use into selected outdoor air degree-day or degree-hour bins and by calculating fuel use per degree-time (e.g., degree-hour). This analysis is performed for each use period 208 or 210 and for each boiler and boiler combination operated within each use period. Input data 202 is monitored 200 continuously and processed 206 at fixed time intervals such as one hour. Longer or shorter processing time periods can be used also. The input data 202 is accummulated by the computer as fuel in engineering units (e.g., gallons of fuel oil, cubic feet of fuel gas, and pounds of solid fuel). In multi-fuel plants these values are converted to thermal units such as Million British Thermal Units (MMBTU), by multiplying the fuel flow rate by the fuel's heating values. (BTU per gallon, BTU per cubic foot, BTU per pound).

The processed fuel use and outdoor air temperature data (fuel use per degree-hour) is then stored in data arrays for each boiler and boiler combination as the information is generated. Each boiler and boiler combination has two separate arrays for each degree-hour bin. The first array is the baseline data 232, 236, 240, 244, 248 252 that is based on historic fuel use data 204 or initial data collected from the sensors 202. The second array shown as adaptive data 234, 238, 242, 246 includes continually updated fuel use and degree-hour information. The adaptive arrays can consist of multiple values or average values for each degree-hour interval. This permits comparison of current data with historic trends and forms the basis for the boiler diagnostic functions. That is, changes in fuel use over time can be evaluated quantitatively.

An example of the data processing and storage is as follows: If the outdoor air temperature is 34 degrees F. for a one-hour period (65−34=31 degree-hours) and boiler number 1 consumed 163 gallons for that hour, during use period number 1, then the fuel use per degree-hour would be 163 gallons of fuel divided by 34 degree-hours which equals 4.8 gallons per degree-hour. This result is stored in 234 as shown. This is shown on FIG. 4 as 202 to 200 to 206 to 208 to 214 to 234. This process continues for all degree-hour bins as new data is input to the computer. This is the basis for the adaptive boiler optimization process that continually monitors changes in fuel consumption as a function of degree-hours for each use period to select the optimum boiler combination producing minimum fuel use.

The boiler fuel use information stored in the adaptive arrays are processed periodically to generate boiler curve fits (fuel use profiles) 270. Optionally, mathematical relationships such as fourth order polynomial curve-fits are produced to represent continuous functions relating fuel use per degree-hour versus degree-hours. Mathematical comparison of the various boiler combinations available at each outdoor air temperature for both the baseline 272 and adaptive 274 data arrays can then be simply made.

Optimum boiler selection, optimum fuel valve positioning, and boiler diagnostics 276 compares the fuel consumption profiles 274 evaluated at the current outdoor air temperature 278 to identify optimum boiler(s) and optionally fuel valve position. Boiler availability 280 and boiler operating limits 282 are operating constraints that effect boiler selection. Optimum boiler information is optionally sent to the boiler controller Interface 286 which automatically starts and stops boilers and modulates the fuel valves. Optimum boiler selection is displayed in graphical or tabular form by the computer 284. Diagnostic information in the form of alarms is presented also by 284. The diagnostic information is generated by comparing current fuel use per degree-hour information 274 to corresponding baseline data 272.

The optimum boiler selection process described herein can also be performed without a computer providing continuous data monitoring and processing. The steps involved include: historic fuel use and outdoor air temperature data acquisition 204; manual data processing and sorting 206 through 254; calculation of boiler curve-fits (manually) 270 over the entire range of outdoor air temperatures; optimum boiler selections schedule as a function of outdoor air temperature, for manual boiler selection 276. The manual boiler selection schedule can be manually updated periodically (monthly, bi-monthly, etc.) to adjust for changes in boiler operating efficiencies over time.

It should be understood by those skilled in the art that various modifications may be made in the present invention without departing from the spirit and scope thereof, as described in the specification and defined in the appended claims.

We claim:

1. A controller system for controlling a plurality of parallel central heating boilers comprising;

a boiler selection means;

said boilers selection means including a fuel consumption profile for at least some of the boilers and boiler combinations capable of satisfying a heating load at a given outdoor air temperature;

said fuel consumption profile comparing the relative efficiency of each boiler or boiler combination in terms of fuel use per degree unit time as a function of degree unit time for each said boiler or boiler combination;

a boiler controller for placing each boiler or boiler combination on line in response to a signal from said boiler selection means;

outdoor air temperature sensing means in communication with said boiler selection means;

means to compare each fuel consumption profile to determine which boiler or boiler combination consumes the least amount of fuel at the sensed outdoor temperature and to signal said boiler selection means to select the determined boiler combination;

whereby the boiler or boiler combination which consumes the lowest amount of fuel at the sensed outdoor air temperatures are operated.

2. A controller system according to claim 1 wherein said boiler selecting means is a computer.

3. A controller system according to claim 2 wherein the computer is a microprocessor.

4. A controller system according to claim 2 further comprising fuel flow meters on the fuel inlet of each boiler in communication with said computer to provide said computer with the current fuel consumption of the boilers in operation;

comparison means to compare the current fuel consumption with the fuel consumption profile for the operating boilers;

means to select and operate a different boiler or boiler combination if said comparison means detects a boiler or boiler combination which will consume less fuel than the combination in operation.

5. A controller system according to claim 1, 2, 3 or 4 further comprising means to update said fuel consumption profile based on current fuel consumption of the boiler in operation and the current outdoor air temperature.

6. A controller system according to claim 5 further comprising operator informing means to indicate when actual fuel consumption exceeds the fuel consumption of the fuel consumption profiles by a predetermined amount.

7. A controller system according to claim 6 wherein said operator informing means is a CRT or a printer.

8. A controller system according to claim 6 wherein said predetermined amount is about 5%.

9. A controller system according to claim 1 wherein said fuel consumption profile includes each boiler or boiler combination capable of satisfying a heating load at a given outdoor temperature.

10. A controller system according to claim 7 comprising means to sense boiler efficiency parameter other than fuel consumption;

means to inform the operator when said fuel efficiency parameters are outside predetermined range.

11. A controller system according to claim 6 wherein said operator informing means displays the fuel consumption profile for each boiler or boiler combination either tabularly or graphically.

12. A controller system for controlling a plurality of parallel heating boilers comprising;

a boiler selection means;

said boiler selection means including a fuel consumption profile for at least some of the boiler, and boiler combination capable of satisfying a heating load at a given outdoor air temperature;

outdoor air temperature sensing means in communication with said boiler selection means;

means to compare each fuel consumption profile to determine which boiler or boiler combination consumes the least amount of fuel at the sensed outdoor temperature;

means to inform the operator of the boiler or boiler combinations which will consume the least amount of fuel at the current outdoor air temperature.

13. A controller system according to claim 1 wherein the fuel consumption profile is in the units of fuel use per degree-day vs. degree-day.

14. A controller system according to claim 12 wherein the fuel consumption profile is in the units of fuel use per degree-day vs. degree-day.

15. A controller system according to claim 1 wherein the fuel consumption profile is in the units of fuel use per degree-hour vs. degree-hour.

16. A controller system according to claim 12 wherein the fuel consumption profile is in the units of fuel use per degree-hour vs. degree-hour.

17. A controller system according to any one of claims 1 to 4 further comprising;

means to operate a boiler or boiler combination which is currently operating but is not contained in the fuel consumption profile for the current outdoor air temperature but was the boiler selected for operation at the previously measured outdoor air temperature;

means to determine the fuel consumption profile of said boiler or boiler combination at the current outdoor air temperature;

means to update the fuel consumption profile to include said boiler or boiler combination at the current outdoor air temperature;

means to discontinue the operation of said boiler or boiler combination when another boiler or boiler combination is determined by said comparison to consume less fuel at the current outdoor air temperature.

18. A controller system according to claim 1 wherein a boiler combination is selected for operation further comprising;

means to operate each boiler of the combination at a plurality of loading levels;

means to monitor the fuel consumption at each loading level;

means to select the loading level which result in the least fuel consumption for the boiler combination.

19. A controller system according to claim 1 further comprising;

means to eliminate from the fuel consumption profile any boiler or boiler combination which is not operational.

20. A method of operating boilers in a multiple boiler heating plant comprising:

(a) operating a plurality of boilers and boiler combinations which will satisfy load demand for a particular heating load as a function of outdoor air temperature over a preselected range of outdoor air temperatures;

(b) measuring the boiler fuel consumption per degree preselected time interval for the operated boilers;

(c) sensing the temperature during said time interval and converting said temperature to degree days;

(d) measuring the current outdoor air temperature and converting said temperature to a degree day;

(e) selecting the boiler or boiler combination which has the lowest fuel consumption per degree day for the degree days equivalent to the measured outdoor temperature;

(f) operating the selected boiler or boiler combination.

21. A method of operating boilers in a multiple boiler heating plant according to claim 20 wherein said preselected range of outdoor air temperatures in paragraph a) is the range of outdoor air temperatures typically encountered in a heating season.

22. The method of operating boilers according to claim 20 wherein in step (a) each boiler and boiler combination which will satisfy a particular heating load as a function of outdoor air temperature is operated.

23. The method of operating boilers according to claim 21 wherein step (a) each boiler and boiler combination which will satisfy a particular heating load as a function of outdoor air temperature is operated.

24. A method of operating boilers in a multiple boiler heating plant according to any one of claims 20, 21, 22 or 23 further comprising:

measuring the current fuel consumption per degree per preselected time interval for the operating boiler or boiler combination and replacing the current fuel consumption for the previously measured consumption of paragraph (b).

25. A method of operating boilers in a multiple boiler heating plant according to any one of claims 20, 21, 22 or 23:

wherein the time interval is day, hour, or shift.

26. A method of operating boilers according to claim 20 further comprising;

measuring the fuel consumption of the boiler or boiler combination in current operation;

comparing the fuel consumption profile for the boiler or boiler combination at the current outdoor air temperature with the measured current fuel consumption;

informing the operator when the fuel consumption of the operating boiler or boiler combination exceeds the fuel consumption of the fuel consumption profile by a predetermined amount.

* * * * *